US010077956B2

(12) United States Patent
Anwar

(10) Patent No.: US 10,077,956 B2
(45) **Date of Patent: *Sep. 18, 2018**

(54) HEAT EXCHANGER WITH ENHANCED AIRFLOW

(71) Applicant: TRANE INTERNATIONAL INC., Davidson, NC (US)

(72) Inventor: Fahad Anwar, Clarksville, TN (US)

(73) Assignee: TRANE INTERNATIONAL INC., Davidson, NC (US)

( * ) Notice: Subject to any disclaimer, the term of this patent is extended or adjusted under 35 U.S.C. 154(b) by 8 days.

This patent is subject to a terminal disclaimer.

(21) Appl. No.: 15/332,339

(22) Filed: Oct. 24, 2016

(65) Prior Publication Data

US 2017/0038167 A1 Feb. 9, 2017

Related U.S. Application Data

(63) Continuation of application No. 14/158,277, filed on Jan. 17, 2014, now Pat. No. 9,476,656.

(60) Provisional application No. 61/753,712, filed on Jan. 17, 2013.

(51) Int. Cl.

| | |
|---|---|
| ***F28F 1/00*** | (2006.01) |
| ***F28F 13/12*** | (2006.01) |
| ***F28D 1/047*** | (2006.01) |
| ***F28F 1/06*** | (2006.01) |
| ***F28F 1/02*** | (2006.01) |
| ***F28F 1/10*** | (2006.01) |

(52) U.S. Cl.

CPC ..... *F28F 13/12* (2013.01); *F28D 1/0475* (2013.01); *F28F 1/025* (2013.01); *F28F 1/06* (2013.01); *F28F 1/10* (2013.01)

(58) Field of Classification Search

CPC ..... F28D 1/0475; F28D 1/047; F28D 1/0476; F28D 1/0477; F28D 1/0478; F28F 1/06; F28F 13/12; F28F 1/424; F28F 1/426; F28F 2001/027

USPC ..... 165/177, 150, 176; 126/110 R, 116 R; 122/235.14, 235.23, 275–276

See application file for complete search history.

(56) References Cited

U.S. PATENT DOCUMENTS

| | | | |
|---|---|---|---|
| 514,338 | A | 2/1894 | Row |
| 2,016,720 | A | 4/1933 | Krause |
| 1,922,838 | A | 8/1933 | Bossart |
| 4,014,962 | A | 3/1977 | Del Notario |
| 4,332,236 | A | 6/1982 | Stora et al. |
| 4,332,294 | A | 6/1982 | Drefahl et al. |
| 4,589,481 | A | 5/1986 | Mansson |
| 4,830,600 | A | 5/1989 | VerShaw et al. |
| 4,974,579 | A | 12/1990 | Shellenberger et al. |
| 5,271,376 | A | 12/1993 | Lu et al. |
| 5,347,980 | A | 9/1994 | Shellenberger |

(Continued)

*Primary Examiner* — Jianying Atkisson
*Assistant Examiner* — Jose O Class-Quinones
(74) *Attorney, Agent, or Firm* — Hamre, Schumann, Mueller & Larson, P.C.

(57) ABSTRACT

Systems, apparatuses, and methods described herein are directed to a heat exchange tube structure and an arrangement of heat exchange tubes that enhance or help promote fluid flow through a heat exchanger. Bend portions of heat exchange tubes may be structured and configured to allow for gaps so that fluid may pass an assembly of the heat exchange tubes. The heat exchange tubes may be arranged to expose the air gaps at the bend portions of the heat exchange tubes to promote fluid flow.

15 Claims, 7 Drawing Sheets

(56) References Cited

U.S. PATENT DOCUMENTS

| | | | | |
|---|---|---|---|---|
| 5,393,224 | A | 2/1995 | Allen et al. | |
| 5,417,199 | A | 5/1995 | Jamieson et al. | |
| 5,540,276 | A | 7/1996 | Adams et al. | |
| 5,573,062 | A | 11/1996 | Ooba et al. | |
| 5,839,505 | A | 11/1998 | Ludwig et al. | |
| 6,006,741 | A * | 12/1999 | Daddis, Jr. ..... | F24H 3/087 126/110 R |
| RE37,009 | E | 1/2001 | Diesch | |
| 6,364,008 | B1 | 4/2002 | Mannoni et al. | |
| 6,422,306 | B1 | 7/2002 | Tomlinson et al. | |
| 6,688,378 | B2 | 2/2004 | O'Donnell et al. | |
| 6,945,320 | B2 | 9/2005 | Harvard, Jr. et al. | |
| 7,011,150 | B2 | 3/2006 | Komatsubara et al. | |
| 7,255,155 | B2 | 8/2007 | O'Donnell et al. | |
| 7,296,620 | B2 | 11/2007 | Bugler, III et al. | |
| 7,779,898 | B2 | 8/2010 | Morrison et al. | |
| 8,215,380 | B2 | 7/2012 | Li et al. | |
| 2002/0005275 | A1 | 1/2002 | O'Donnell et al. | |
| 2010/0258280 | A1 | 10/2010 | O'Donnell et al. | |

* cited by examiner

HEAT EXCHANGER WITH ENHANCED AIRFLOW

FIELD OF TECHNOLOGY

Heat exchangers of heating, ventilation and air conditioning (HVAC) systems are described. Heat exchangers described herein are to embodiments and aspects of a heat exchange tube structure used in the heat exchanger and an arrangement of heat exchange tubes in the heat exchanger. The heat exchange tube structure and the tubes in their arrangement can enhance airflow through the heat exchanger, such as in an HVAC system.

BACKGROUND

A HVAC system can include a compressor or pump, one or more heat exchangers, and one or more fans to allow for return and supply air to appropriately move through the system. The heat exchanger(s) are configured to help establish a heat exchange relationship between a first fluid and a second fluid. For example, a heat exchanger designed as an arrangement of tubes can carry or otherwise circulate the first fluid, which can exchange heat with the second fluid that passes through the arrangement of tubes on the outside of the tubes. As one example, the first fluid can be a heated gas that is carried through the tubes and the second fluid can be air that flows or passes over the outside of the tubes, which is then heated through the heat exchange with the heated gas.

SUMMARY

Systems, apparatuses, and methods described herein are directed to a heat exchange tube structure and an arrangement of heat exchange tubes that enhance or help promote fluid flow through a heat exchanger. Generally, the heat exchange tubes and their arrangement are structured and configured to enhance fluid flow, which can include a reduction of pressure drop (or avoiding increase(s) in pressure drop), as a fluid passes through a heat exchanger, such as when fluid flows outside of the heat exchange tubes. Bend portions of heat exchange tubes may be structured and configured to allow for gaps so that fluid may pass through an assembly of the heat exchange tubes.

In one embodiment, a heat exchange tube can include a first leg connected to a bend portion, where the bend portion is connected to a second leg. The heat exchange tube can be formed or otherwise arranged to have the first and second legs generally parallel due to the connection with the bend portion. The heat exchange tube has a flow passage through the first leg, bend portion, and second leg, and the flow passage can carry or pass a fluid to establish a heat exchange relationship with a fluid passing over the outside of the heat exchange tube. The bend portion can have a first bend that connects the first leg to the bend portion and a second bend that connects the bend portion to the second leg. The first and second bends can create an opening proximate the bend portion with a certain geometry that can promote fluid flow passing over the heat exchange tube.

In some embodiments, the first bend has an inner angle that is relatively acute to the inner angle of the second bend, which would have an angle that is relatively obtuse to the inner angle of the first bend. In some embodiments the second bend has an inner angle that is relatively acute to the inner angle of the first bend, which would have an angle that is relatively obtuse to the inner angle of the second bend.

In some embodiments, an arrangement of heat exchange tubes can have one or more air gaps therebetween resulting from the geometry of the opening of each heat exchange tube. The air gap(s) can reduce pressure drop, which can also mean avoiding an increase(s) in pressure drop, where fluid may flow over the bend portions of the heat exchange tubes. In some embodiments, the heat exchange tubes can have a staggered or an offsetting arrangement, which in some embodiments may include an alternating array of the heat exchange tubes. The arrangement can expose the opening at the bend portions of some of the tubes, which can enhance or otherwise promote fluid flow.

Other features and aspects of the embodiments will become apparent by consideration of the following detailed description and accompanying drawings.

BRIEF DESCRIPTION OF THE DRAWINGS

Reference is now made to the drawings in which like reference numbers represent corresponding parts throughout.

DETAILED DESCRIPTION

Figure 1:
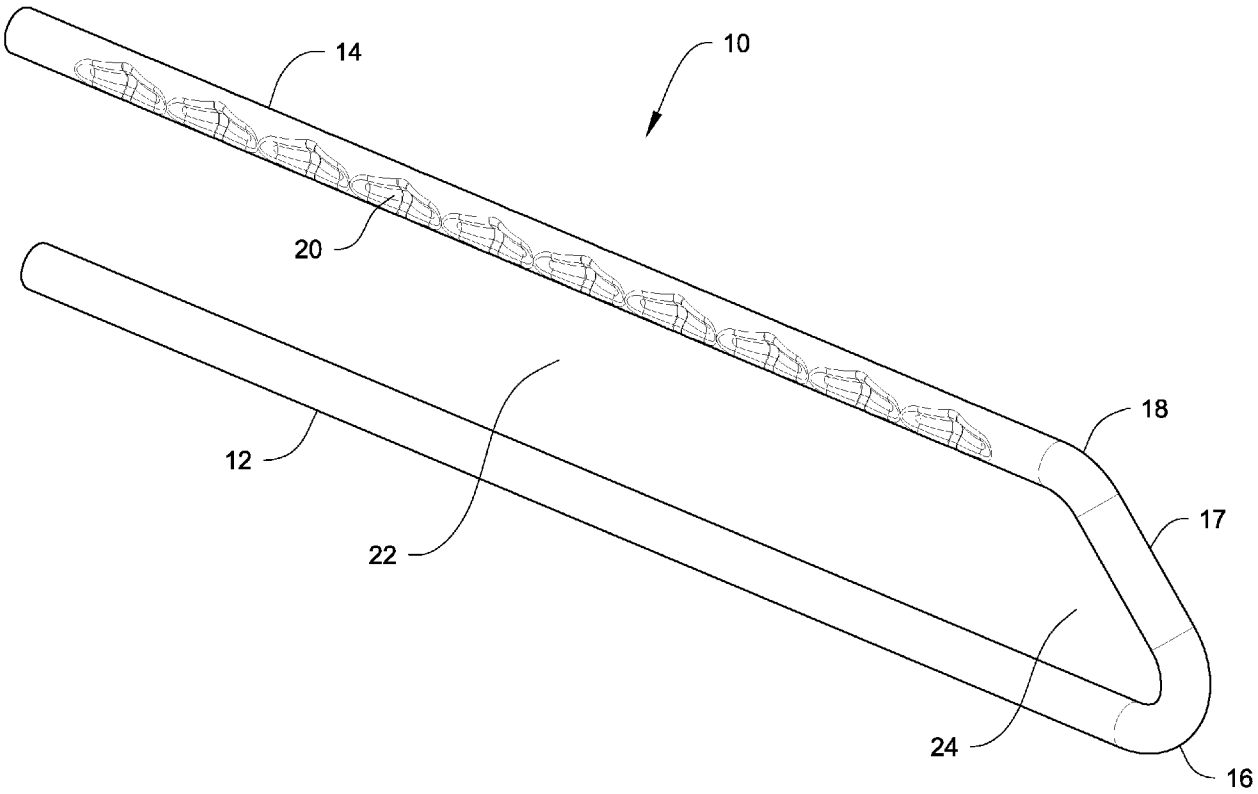
FIG. 1 shows a perspective view of one embodiment of a heat exchange tube.

Systems, apparatuses, and methods described herein are directed to a heat exchange tube structure and an arrangement of heat exchange tubes that enhance or help promote fluid flow through a heat exchanger. Generally, the heat exchange tubes and their arrangement are structured and configured to enhance fluid flow, which can include a reduction of pressure drop (or avoiding increase(s) in pressure drop), as a fluid passes through a heat exchanger, such as when fluid flows outside of the heat exchange tubes. Bend portions of the heat exchange tubes may be structured and configured to allow for gaps so that fluid may pass through an assembly of the heat exchange tubes.

In some embodiments, applications of the heat exchange tubes and their arrangement can be used for example in gas heat options. The heat exchange tubes can be made of a metal material, such as steel, however, it is to be appreciated that the material of the heat exchange tubes are to be a material compatible with the fluid(s) used in the heat exchanger, which may depend upon the application. In many instances, such heat exchange tubes are bent back and forth to lengthen fluid paths, such as for example hot gas paths in a gas heat option. A fluid may be caused to flow over the outside of the heat exchange tubes to create a heat exchange relationship with the fluid passing inside the heat exchange tubes. For example, in a gas heat application, the fluid passing outside the heat exchange tubes can be a flow of air which is heated by heated gas passing through the heat exchange tubes, which the heated air flow can be used to heat an enclosed space such as in a building. It will be appreciated that the fluids for heat exchange are not limited to a gas heat option, and thus are not limited to heated gas and air as the fluids. Rather, the embodiments herein may be applicable for use with other fluids in heat exchange applications, such as but not limited to water, refrigerant, and other gas/air flows.

In some applications, such as in a unitary air conditioning/heating product with a gas heat option, a heat exchanger can be designed so that the heat exchange tubes allow reduced pressure drop of an air flow over the heat exchange tubes, which can enhance airflow performance by reducing the overall indoor fan power consumption. In some cases, this air flow can be in a certain direction, such as in a horizontal airflow application across the length of the heat exchange tubes. Such products may include applications in the light commercial and/or residential applications, which may include a gas heat option.

One function of the heat exchange tubes and their arrangement is to reduce the pressure drop through the heat exchanger by altering, such as by staggering, or such as by alternating every other heat exchange tube to expose openings of the heat exchange tubes that can reduce pressure drop and improve airflow performance. This can be useful, for example, in a horizontal airflow application through the heat exchanger. This can also be helpful in a down airflow application as well depending on the design and physical orientation of the heat exchanger and its application in the product. Generally, the arrangement of the heat exchange tubes allow for good airflow performance.

Figure 2:
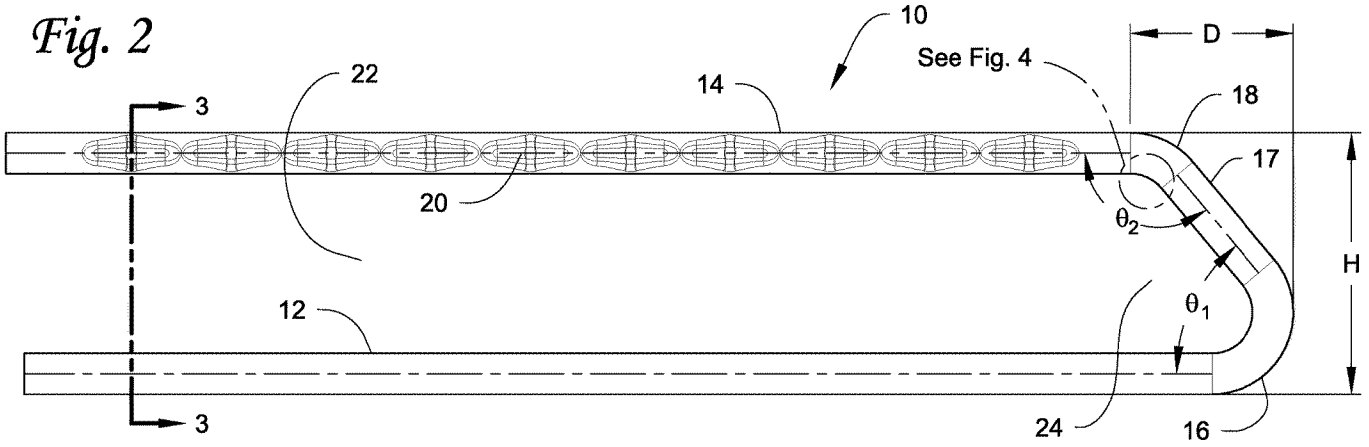
FIG. 2 shows a side view of the heat exchange tube of FIG. 1.
Figure 3:
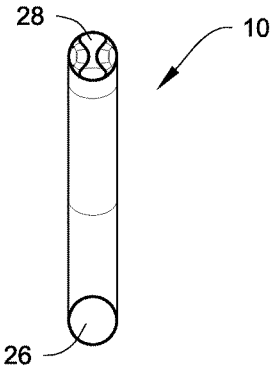
FIG. 3 shows a sectional view of the heat exchange tube of FIG. 1 taken from line A-A of FIG. 2.

FIGS. 1 to 4 show one embodiment of a heat exchange tube 10. In one embodiment, the heat exchange tube 10 can include a first leg 12 connected to a bend portion 17, where the bend portion 17 is connected to a second leg 14. As shown, the heat exchange tube 10 can be formed or otherwise arranged to have the first and second legs 12, 14 generally parallel due to the connection with the bend portion 17. A general opening 22 is defined between the first leg 12 and the second leg 14. As shown in FIG. 3, the heat exchange tube 10 has a flow passage 26, 28 through the first leg 12, bend portion 17, and second leg 14. The flow passage 26, 28 can carry or pass a fluid to establish a heat exchange relationship with a fluid passing over the outside of the heat exchange tube 10. The bend portion 17 can have a first bend 16 that connects the first leg 12 to the bend portion 17 and a second bend 18 that connects the bend portion 17 to the second leg 18. The first and second bends 16, 18 can create a fluid flow opening 24 proximate the bend portion 17 with a certain geometry that can promote fluid flow passing over the heat exchange tube 10.

In some embodiments, the heat exchange tube 10 can have one or more external and/or internal surfaces 20 that can help promote turbulence in the flow internal and/or external to the tubes. Such surfaces can include but are not limited to dimples, recesses, contours, curvatures, and the like. As shown, the surfaces 20 are dimples 20 located along the second leg 14, e.g. the top leg relative to the first or bottom leg 12. In some embodiments, the dimples 20 can be a non-parabolic shape, where there is an internal gap of about 13% of the outer diameter of the overall tube 10. In other embodiments, rather than dimples the surfaces 20, may be flattened sections relative to the overall shape of the tube 10 and may extend on the along portions of the second leg 14, e.g. the top leg relative to the first or bottom leg 12. For example, the flattened section(s) may extend the same amount of the length of the second leg 14 as shown for the dimples. It will be appreciated that the surfaces are not limited to the dimples 20 and are not limited in their location on the second leg, but may be on other areas of the heat exchange tube 10 as may be desired, suitable and/or necessary. As shown in FIG. 3, the dimples 20 can create inner channels in the flow passage 28 of the second leg 14. For example, as shown in FIG. 3, there is an internal gap, which may be about 0.3 inches between the internal surfaces of the tube 10, and where the gap is at or about 13% of the outer diameter of the tube 10, or in some cases about 13.3% or more. In some embodiments and applications, the outer diameter of the tube 10 may be at or about 2.25 inches. It will be appreciated that the gap relative to the outer diameter can be other percentages as desired, suitable, and/or necessary.

Figure 4:
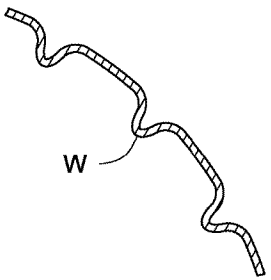
FIG. 4 shows a wall section of the bend portions of the heat exchange tube of FIG. 1.

In some embodiments such as shown in FIG. 2, the first bend 16 has an inner angle $\theta_1$ that is relatively acute to the inner angle $\theta_2$ of the second bend 18, which would have an angle that is relatively obtuse to the inner angle $\theta_1$ of the first bend. The configuration of the first and second bends 16, 18 of the bend portion can create a certain geometry, such that when the heat exchange tube 10 is arranged with other heat exchange tubes, which may be similarly constructed, the fluid flow opening 24 can be exposed. FIG. 4 shows a wall section W of the bend portions of the heat exchange tube 10, which can have wrinkles with sides that help maintain the structure.

As shown, the bend portion 17 and bends 16, 18 can have a general height H and a length or distance D, where the first bend 16 is at one end of the length defined by D and the second bend 18 is at the other end of the length defined by D. As shown, the first bend is located farther from the first and second legs 12, 14 relative to the second bend 18 in the longitudinal direction which is the lengths of the first and second legs 12, 14. As shown, the bend portion 17 and bends 16, 18 generally form a triangle-like bend area of the heat exchange tube 10, and where the opening 24 generally has a triangle-like shape defined by D and H of the bend portion 17.

In some embodiments, the inner angles $\theta_1$, $\theta_2$ can generally have the sum of about 180° so that the bend portion 17 can accommodate the generally parallel relationship of the first and second legs 12, 14. In some embodiments, the inner angle $\theta_1$ of the first bend can be about 30°, while the inner angle $\theta_2$ of the second bend can be about 150°. It will be appreciated that these angles can vary and are not limited to these angles.

Figure 5:
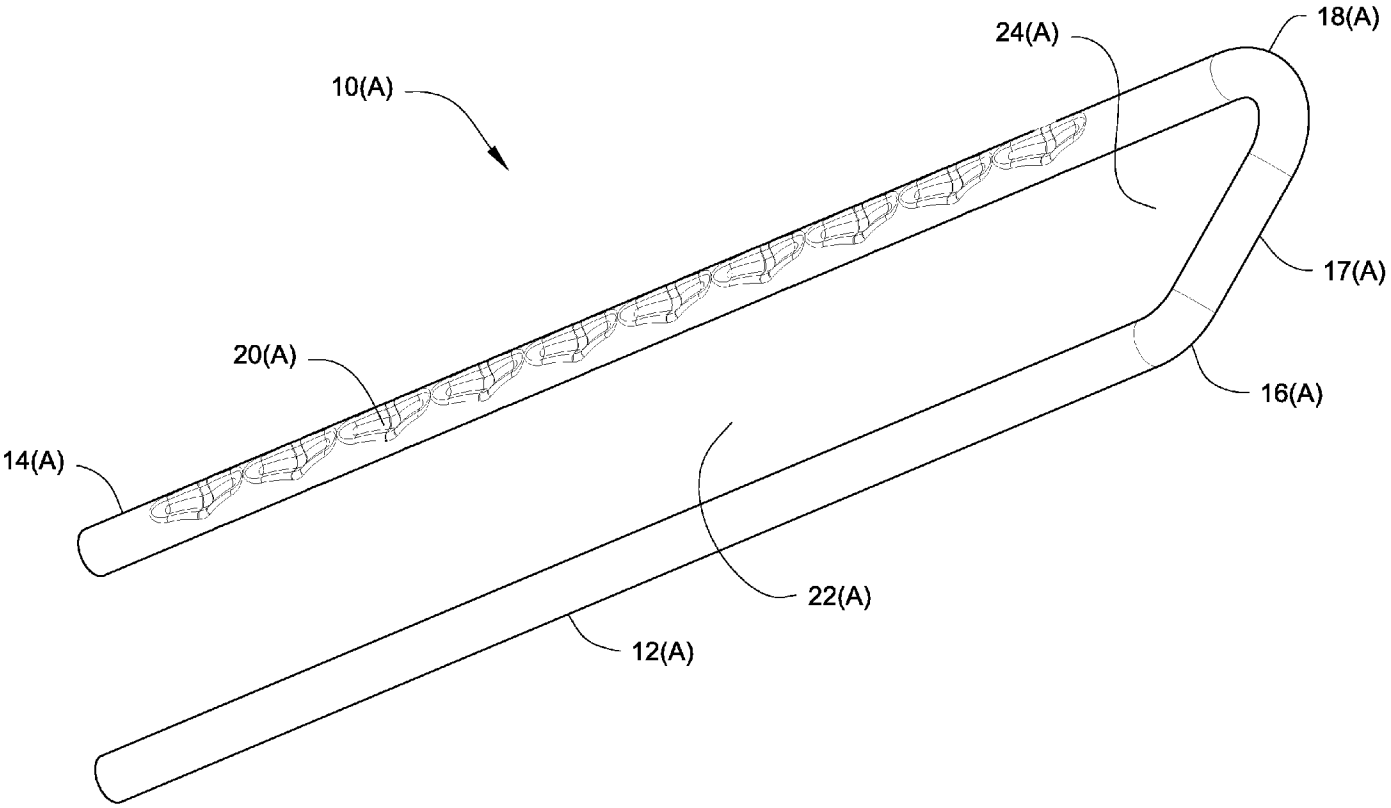
FIG. 5 shows a perspective view of another embodiment of a heat exchange tube.
Figure 6:
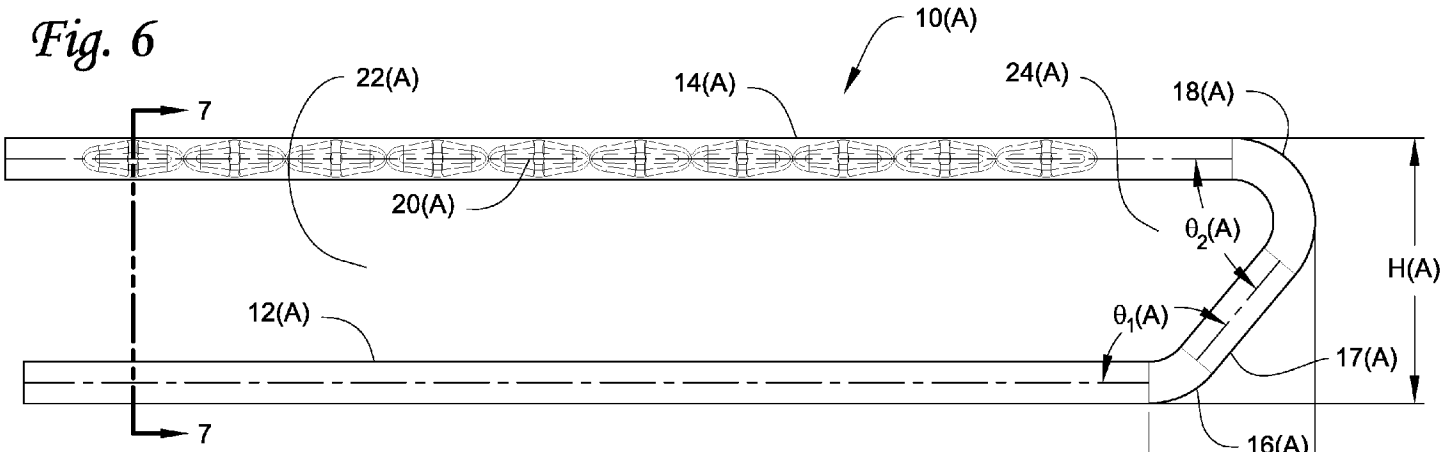
FIG. 6 shows a side view of the heat exchange tube of FIG. 5.
Figure 7:
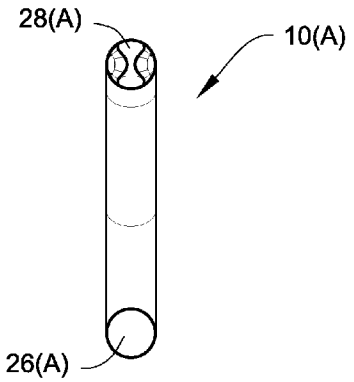
FIG. 7 shows a sectional view of the heat exchange tube of FIG. 5 taken from line B-B of FIG. 6.

In some embodiments the second bend 18 has an inner angle $\theta_2$ that is relatively acute to the inner angle $\theta_1$ of the first bend 16, which would have an angle that is relatively obtuse to the inner angle $\theta_2$ of the second bend. FIGS. 5 to 7 show one embodiment of this.

FIGS. 5 to 7 show another embodiment of a heat exchange tube 10(A). The heat exchange tube 10(A) is substantially similar to the heat exchange tube 10, except the heat exchange tube 10(A) has been "flipped" compared to heat exchange tube 10. Generally, the first leg 12(A) is shorter than the second leg 14(A), so that the inner angles $\theta_1$(A) and $\theta_2$(A) have been switched when comparing to the heat exchange tube 10. The heat exchange tube 10(A) otherwise has a similar structure and includes the first leg 12(A) connected to a bend portion 17(A), where the bend portion 17(A) is connected to the second leg 14(A). The heat exchange tube 10(A) also can be formed or otherwise arranged to have the first and second legs 12(A), 14(A) generally parallel due to the connection with the bend portion 17(A). A general opening 22(A) is defined between the first leg 12(A) and the second leg 14(A). As shown in FIG. 7, the heat exchange tube 10(A) has a flow passage 26(A), 28(A) through the first leg 12(A), bend portion 17(A), and second leg 14(A). The flow passage 26(A), 28(A) can carry or pass a fluid to establish a heat exchange relationship with a fluid passing over the outside of the heat exchange tube 10(A). The bend portion 17(A) can have a first bend 16(A) that connects the first leg 12(A) to the bend portion 17(A) and a second bend 18(A) that connects the bend portion 17(A) to the second leg 18(A). The first and second bends 16(A), 18(A) can create a fluid flow opening 24(A) proximate the bend portion 17(A) with a certain geometry that can promote fluid flow passing over the heat exchange tube 10(A).

In some embodiments, the heat exchange tube 10(A) can have one or more external and/or internal surfaces 20(A) that can help promote turbulence in the flow internal and/or external to the tubes. Such surfaces can include but are not limited to dimples, recesses, contours, curvatures, and the like. As shown, the surfaces 20(A) are dimples 20(A) located along the second leg 14(A), e.g. the top leg relative to the first or bottom leg 12(A). In some embodiments, the dimples 20(A) can be a non-parabolic shape, where there is an internal gap of about 13% of the outer diameter of the overall tube 10(A). In other embodiments, rather than dimples the surfaces 20(A), may be flattened sections relative to the overall shape of the tube 10(A) and may extend on the along portions of the second leg 14(A), e.g. the top leg relative to the first or bottom leg 12(A). For example, the flattened section(s) may extend the same amount of the length of the second leg 14(A) as shown for the dimples. It will be appreciated that the surfaces are not limited to the dimples 20(A) and are not limited in their location on the second leg, but may be on other areas of the heat exchange tube 10(A) as may be desired, suitable and/or necessary. As shown in FIG. 7, the dimples 20(A) can create inner channels in the flow passage 28(A) of the second leg 14(A). For example, as shown in FIG. 7, there is an internal gap, which may be about 0.3 inches between the internal surfaces of the tube 10(A), and where the gap is at or about 13% of the outer diameter of the tube 10(A), or in some cases about 13.3% or more. In some embodiments and applications, the outer diameter of the tube 10(A) may be at or about 2.25 inches. It will be appreciated that the gap relative to the outer diameter can be other percentages as desired, suitable, and/or necessary.

Figure 10:
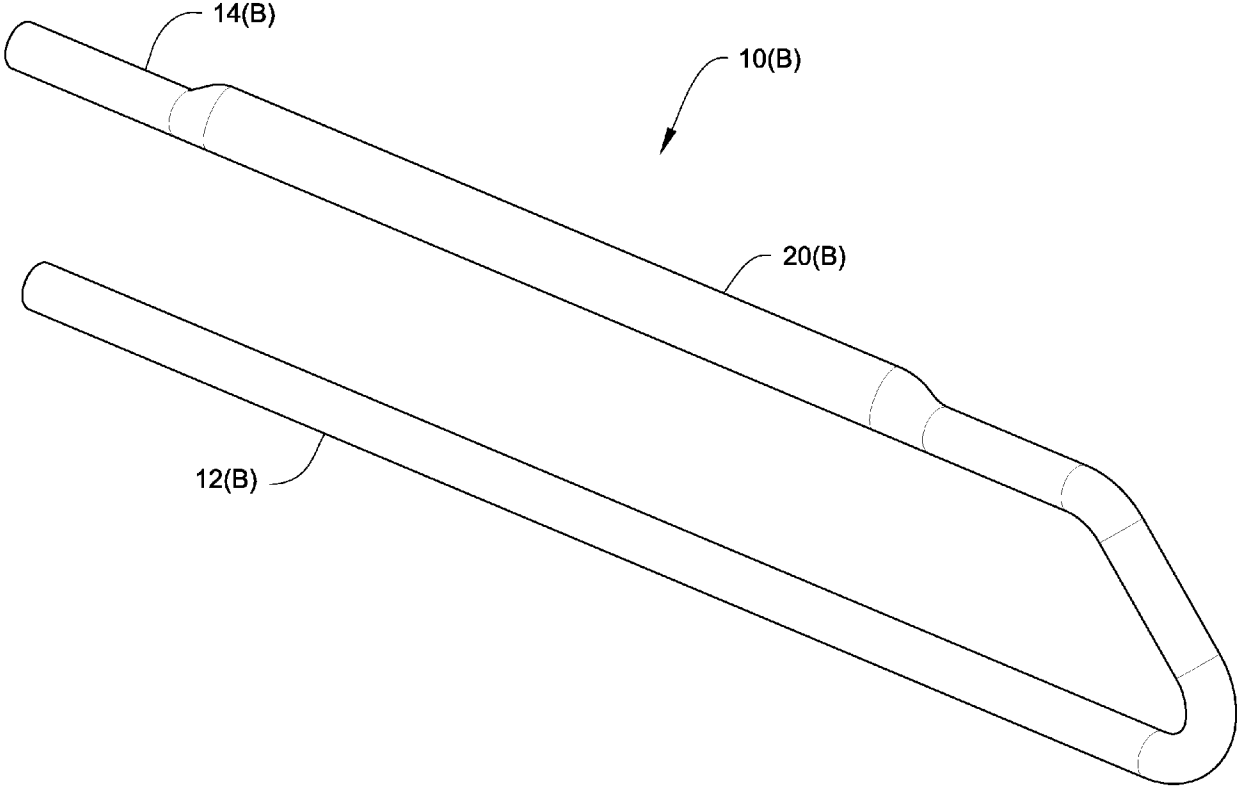
FIG. 10 shows perspective of another embodiment of a heat exchange tube with a flattened section.

In the example of a flattened section(s), FIG. 10 shows one embodiment of a tube 10(B) with a flattened section 20(B) that extends higher than the top of the tube 10(B), but can be relatively level with the bottom of the tube 10(B). As shown in FIG. 10, the flattened section is 20(B), the second or upper leg is 14(B), and the first or lower leg is 12(B). In some embodiments, the flattened section 20(B) such as shown in FIG. 10 may be vertically oriented or upright relative to the axis of the tube 10(B) perpendicular to the longitudinal axis of the tube 10(B). It will be appreciated that the flattened section 20(B) may also be angled relative to the axis of the tube 10(B) perpendicular to the longitudinal axis of the tube 10(B). It will be appreciated that the tube 10(B) is similar to the tube 10 in FIG. 1, and can include the same bend portion, bends, and relative bend angles. It will also be appreciated that the tube 10(A) in FIG. 5 may also be constructed to have a flattened portion(s).

In some embodiments such as shown in FIG. 6, the first bend 16(A) has an inner angle $\theta_1$(A) that is relatively obtuse to the inner angle $\theta_2$(A) of the second bend 18(A), which would have an angle that is relatively acute to the inner angle $\theta_1$(A) of the first bend 16(A). The configuration of the first and second bends 16(A), 18(A) of the bend portion can create a certain geometry, such that when the heat exchange tube 10(A) is arranged with other heat exchange tubes, which may be similarly constructed, the fluid flow opening 24(A) can be exposed.

As shown, the bend portion 17(A) and bends 16(A), 18(A) can have a general height H(A) and a length or distance D(A), where the first bend 16(A) is at one end of the length defined by D and the second bend 18(A) is at the other end of the length defined by D. As shown, the second bend 18(A) is located farther from the first and second legs 12(A), 14(A) relative to the first bend 16(A) in the longitudinal direction which is the lengths of the first and second legs 12(A), 14(A). As shown, the bend portion 17(A) and bends 16(A), 18(A) generally form a triangle-like bend area of the heat exchange tube 10(A), and where the opening 24(A) generally has a triangle-like shape defined by D(A), H(A) of the bend portion 17(A).

In some embodiments, the inner angles $\theta_1$(A), $\theta_2$(A), can generally have the sum of about 180° so that the bend portion 17(A) can accommodate the generally parallel relationship of the first and second legs 12(A), 14(A). In some embodiments, the inner angle $\theta_1$(A) of the first bend can be about 30°, while the inner angle $\theta_2$(A) of the second bend can be about 150°. It will be appreciated that these angles can vary and are not limited to these angles.

FIGS. 1 to 7 show individual tubes 10 and 10(A) that generally have two bends (one obtuse and one acute), where the sum of the angles of two bends is about 180°.

Figure 8A:
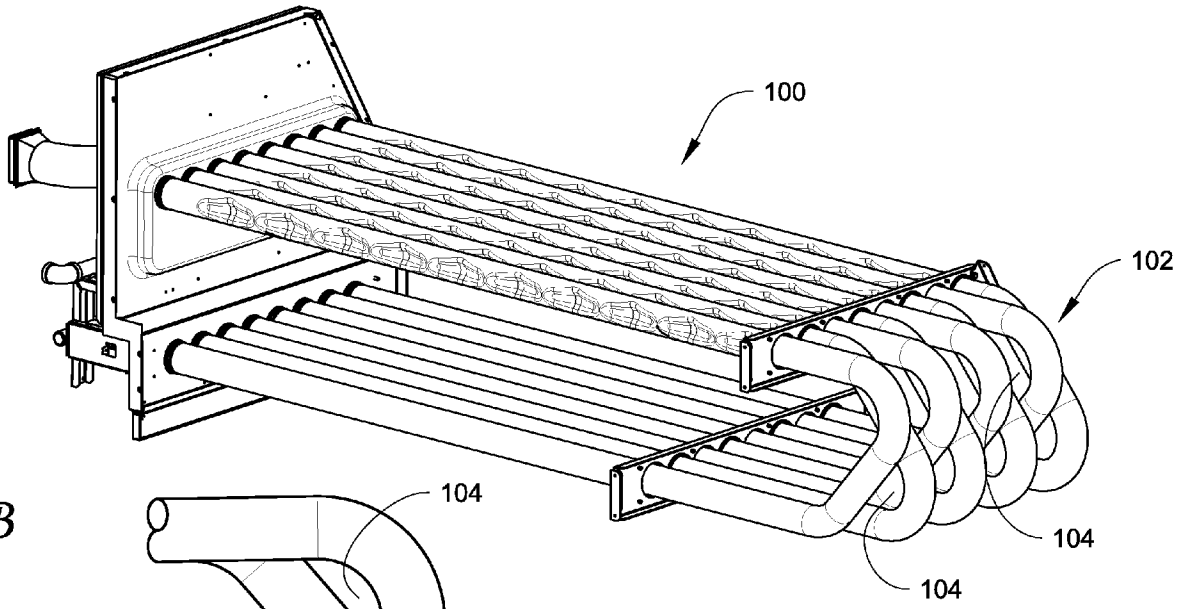
FIG. 8A shows one embodiment of an arrangement of heat exchange tubes, and shows the bend portions of the heat exchange tubes.
Figure 8B:
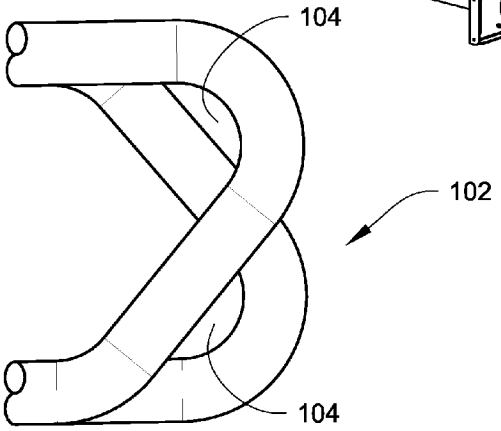
FIG. 8B shows a side view of the arrangement of heat exchange tubes of FIG. 8A at the bend portions of the heat exchange tubes.

FIGS. 8A and 8B show one embodiment of an arrangement 100 of heat exchange tubes. In some embodiments, an arrangement 100 of heat exchange tubes can have one or more air gaps 104 therebetween resulting from the geometry of the openings, e.g. 24, 24(A) of each heat exchange tube. FIGS. 8A and 8B show one embodiment of an arrangement of heat exchange tubes using the tubes 10 and 10(A) from FIGS. 1 to 7 above. The air gap(s) 104 can reduce pressure drop, which can also mean avoiding an increase(s) in pressure drop, where fluid may flow over the bend portions of the heat exchange tubes. The air gaps can be located between the bend region 102 of the arrangement 100.

In some embodiments, the heat exchange tubes can have a staggered or an offsetting arrangement, which in some embodiments may include an alternating array of the heat exchange tubes. In the embodiment shown in FIGS. 8A and 8B, the heat exchange tubes are arranged in an alternating configuration. However, it will be appreciated that the alternating configuration is not required, as other arrangements are possible to create one or more of the air gaps as desired, suitable, and/or necessary. Generally, the arrangement is to expose one or more of the openings (e.g. 24, 24(A)) located at bend portions (e.g. 17, 17(A)) of some of the heat exchange tubes (e.g. 10, 10(A)), which can enhance or otherwise promote fluid flow for example at this portion of the heat exchanger.

The arrangement as shown in FIGS. 8A and 8B can use two different tubes which are flipped in 180° in an alternating configuration, e.g. one tube with respect to the other tube, to achieve air gaps for the indoor air to pass without excessive pressure drop through the heat exchanger system in a cooling and a heat mode.

Figure 9:
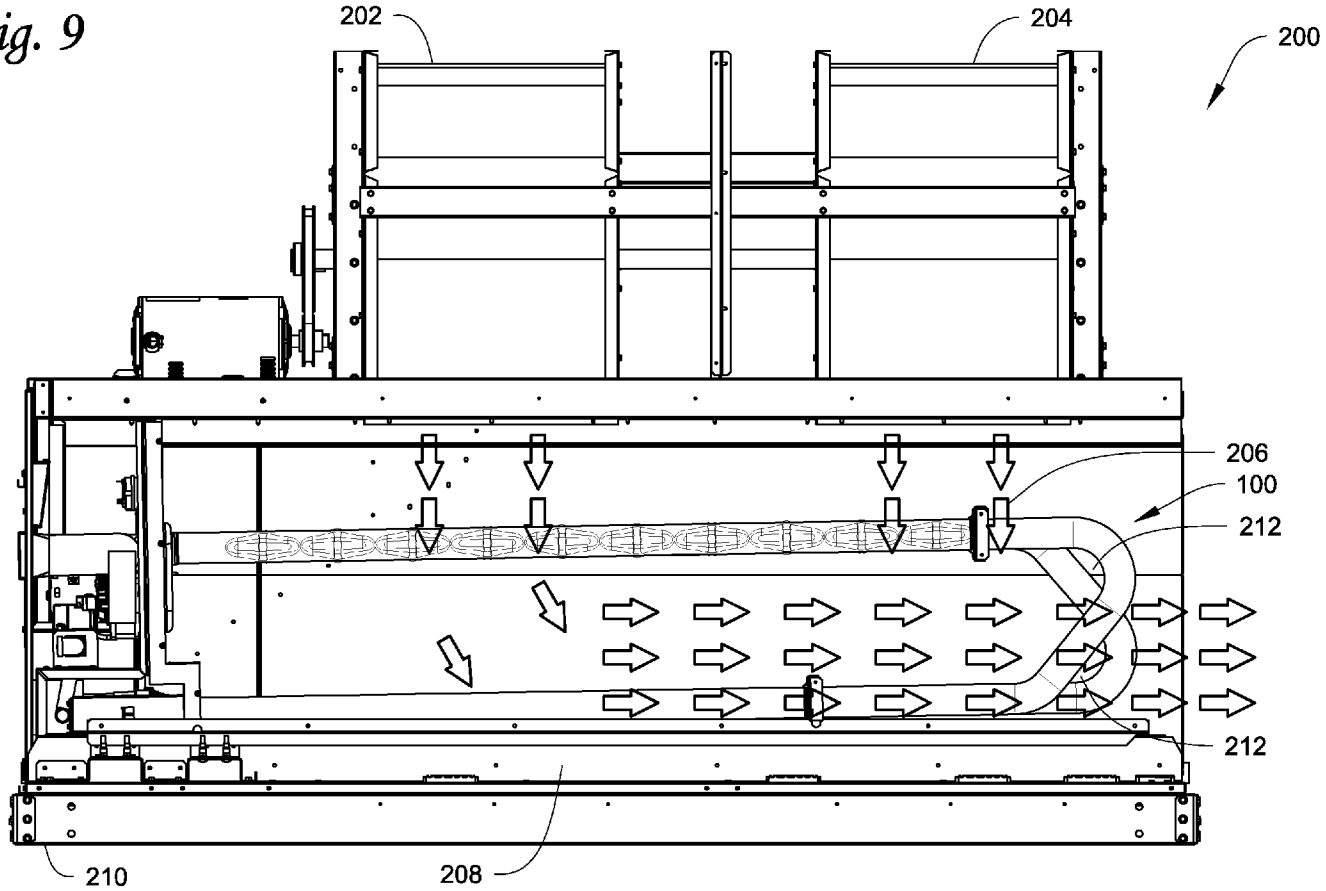
FIG. 9 shows an inside plan view of one embodiment of a unit which may be used in a HVAC system that has the arrangement of heat exchange tubes of FIGS. 8A and 8B.

FIG. 9 shows one embodiment of a unit 200 which may be used in a HVAC system that has the arrangement 100 of heat exchange tubes of FIGS. 8A to 8C. The unit 200 can be a rooftop unit, for example, that may have air supply inlets 202, 204 which direct air flow 206 into the unit 200 and over the heat exchanger 208 along the base 210. In some embodiments, the application of the tube arrangement 100 can be for air flow that is directed downward into the unit 200 and horizontally out of the unit (see direction of arrows 206) over the heat exchanger. It will be appreciated that this air flow configuration is merely exemplary and the arrangement 100 is not limited for use with horizontal air flow applications, e.g. and may also be useful in down flow applications. At 212, the air gaps (e.g. 104) are shown which can help promote fluid flow (e.g. air) through the heat exchanger, so as to reduce (or limit increase) in pressure drop.

It will be appreciated that the flipped angled tube arrangement as shown is just one orientation of the heat exchange tube with respect to another heat exchange tube, such as the adjacent tube in the arrangement. In some examples the arrangement can be alternating to every other tube as shown. It will be appreciated that the arrangement does not have to be alternating but can generally be staggered so that tubes with the same geometry at the bend portions can be arranged to create the air gaps. It will also be appreciated that the air gaps do not have to be present between each of the tubes in certain circumstances that may be desired and/or needed. Rather, the air gaps can be present with less frequency, where some tubes do not have the air gap therebetween.

It will also be appreciated that the geometry of the bend portions of the heat exchange tubes is not to be limiting, and is not limited to the triangle-like shape of FIGS. 1 to 7. For example, in some cases, the angles may be roughly 90°, such as in cases where a triangle-like shape is not employed, but where an arrangement of heat exchange tubes have bend portions that do not extend in equal distances in the longitudinal direction, and can have an offsetting arrangement in the longitudinal direction of the tubes.

Generally, the inner angles (e.g. $\theta_1$, $\theta_2$, $\theta_1$(A), $\theta_2$(A)) of the first and second bends (e.g. 16, 18, 16(A), 18(A)) can vary to obtain the desired opening (e.g. 24, 24(A)) used in the heat exchanger design. Such different configurations can avoid too many of the tubes from having the same orientation, which can introduce pressure drop when the large amount of airflow passes through these tubes. Where enough tubes are arranged in the same orientation, such an arrangement can form a wall for flow external to the heat exchange tubes, e.g. air flow, which can cause pressure drop. The embodiments herein can avoid or at least reduce such an effect.

With regard to the foregoing description, it is to be understood that changes may be made in detail, especially in matters of the construction materials employed and the shape, size and arrangement of the parts without departing from the scope of the present invention. It is intended that the specification and depicted embodiment to be considered exemplary only, with a true scope and spirit of the invention being indicated by the broad meaning of the claims.

The invention claimed is:

1. A heat exchanger, comprising:

an alternating arrangement of heat exchange tubes including:

a first heat exchange tube;

a second heat exchange tube separate from the first heat exchange tube and adjacent to the first heat exchange tube; and a fluid flow gap configured from an arrangement of the first heat exchange tube and the second heat exchange tube, the first heat exchange tube includes:

a first leg, a second leg, a bend portion connected to the first leg and the second leg, and a flow passage through the first leg, the bend portion, and the second leg, the bend portion is disposed between the first leg and the second leg, the first and second legs are generally parallel to each other due to the connection with the bend portion, the bend portion is disposed at one end of the first heat exchange tube, and the first and second legs have free ends disposed at an end opposite the bend portion, the flow passage is configured to pass a first portion of a first fluid inside the first heat exchange tube to establish a heat exchange relationship with a second fluid passing over and outside the first heat exchange tube, the bend portion includes a first bend that connects the first leg to the bend portion and a second bend that connects the bend portion to the second leg, the first and second bends create a fluid flow opening proximate the bend portion configured to promote fluid flow through the fluid flow opening of the first heat exchange tube and to pass outside the first heat exchange tube, the second heat exchange tube includes:

a first leg, a second leg, a bend portion connected to the first leg and the second leg, and a flow passage through the first leg, the bend portion, and the second leg, the bend portion is disposed between the first leg and the second leg, the first and second legs are generally parallel to each other due to the connection with the bend portion, the bend portion is disposed at one end of the second heat exchange tube, and the first and second legs have free ends disposed at an end opposite the bend portion, the flow passage is configured to pass a second portion of the first fluid inside the second heat exchange tube to establish a heat exchange relationship with the second fluid passing over and outside the second heat exchange tube, the bend portion includes a first bend that connects the first leg to the bend portion and a second bend that connects the bend portion to the second leg, the first and second bends create a fluid flow opening proximate the bend portion configured to promote fluid flow through the fluid flow opening of the second heat exchange tube and to pass outside the second heat exchange tube, the first heat exchange tube and the second heat exchange tube being alternatingly arranged such that the first heat exchange tube and the second heat exchange tube are flipped 180° relative to each other such that the second bend of one of the first heat exchange tube and the second heat exchange tube is disposed in a length direction of the second leg of the one of the first heat exchange tube and the second heat exchange tube, the length direction defined from the free ends of the one of the first heat exchange tube and the second heat exchange tube towards the bend portion of the one of the first heat exchange tube and the second heat exchange tube, so that the second bend of the one of the first heat exchange tube and the second heat exchange tube extends beyond the bend portion of the other of the first heat exchange tube and the second heat exchange tube in the length direction, the fluid flow gap being defined by the second bend of the one of the first heat exchange tube and the second heat exchange tube, which extends in the length direction beyond the bend portion of the other of the first heat exchange tube or the second heat exchange tube.

2. The heat exchanger of claim 1, wherein in one of the first heat exchange tube or the second heat exchange tube, the first bend includes an inner angle that is acute relative to an inner angle of the second bend, and the second bend includes an inner angle that is obtuse relative to the inner angle of the first bend, and wherein in the other of the first heat exchange tube or the second heat exchange tube, the first bend includes an inner angle that is obtuse relative to an inner angle of the second bend, and the second bend includes an inner angle that is acute relative to the inner angle of the first bend.

3. The heat exchanger of claim 1, wherein the first and second bends of the first and second heat exchange tubes respectively form the fluid flow openings to resemble a triangle-like bend area.

4. The heat exchanger of claim 1, wherein one of the first leg and the second leg of each of the first heat exchange tube and the second heat exchange tube is oriented relatively above the other of the first leg and the second leg of each of the first heat exchange tube and the second heat exchange tube, and has at least one of an internal surface and an external surface that are suitable to promote turbulence of fluid flowing through the flow passage.

5. The heat exchanger of claim 4, wherein the at least one of the internal surface and the external surface includes one or more dimples.

6. The heat exchanger of claim 1, wherein the arrangement of the heat exchange tubes includes the first and the second heat exchange tubes alternated to form a staggered configuration at ends of the heat exchange tubes so as to form multiple fluid flow gaps.

7. The heat exchanger of claim 1, wherein the arrangement of the heat exchange tubes is a component of one of a unitary air conditioning product and a unitary air heating product.

8. The heat exchanger of claim 1, wherein the second leg of the first heat exchange tube is oriented relatively above the first leg, the second leg having dimples to promote turbulence of the first fluid flowing inside the flow passage, the dimples forming an internal gap in the flow passage, the internal gap being at or about 13% or greater than an outer diameter of the heat exchange tube.

9. The heat exchanger of claim 1, wherein the second leg of the second heat exchange tube is oriented relatively above the first leg, the second leg having dimples to promote turbulence of the first fluid flowing inside the flow passage, the dimples forming an internal gap in the flow passage, the internal gap being at or about 13% or greater than an outer diameter of the heat exchange tube.

10. The heat exchanger of claim 1, wherein the second bend is located farther from the first and second legs relative to the first bend in the length direction of the first and second legs.

11. A method of fluid heat exchange, comprising:

directing a first fluid through an arrangement of heat exchange tubes;

directing a second fluid over and outside of the arrangement of heat exchange tubes, the arrangement of heat exchange tubes including a first heat exchange tube, a second heat exchange tube separate from the first heat exchange tube and adjacent to the first heat exchange tube, and a fluid flow gap, the first heat exchange tube includes: a first leg, a second leg, a bend portion connected to the first leg and the second leg, and a flow passage through the first leg, the bend portion, and the second leg, the bend portion disposed between the first leg and the second leg, the first and second legs are generally parallel to each other due to the connection with the bend portion, the bend portion is disposed at one end of the first heat exchange tube, and the first and second legs have free ends disposed at an end opposite the bend portion, the flow passage configured to pass a first portion of the first fluid inside the first heat exchange tube to establish a heat exchange relationship with the second fluid passing over outside the first heat exchange tube, the bend portion includes a first bend that connects the first leg to the bend portion and a second bend that connects the bend portion to the second leg, the first and second bends create a fluid flow opening proximate the bend portion configured to promote fluid flow through the fluid flow opening of the first heat exchange tube and to pass outside the first heat exchange tube, the second heat exchange tube includes: a first leg, a second leg, a bend portion connected to the first leg and the second leg, and a flow passage through the first leg, the bend portion, and the second leg, the bend portion disposed between the first leg and the second leg, the first and second legs are generally parallel to each other due to the connection with the bend portion, the bend portion is disposed at one end of the second heat exchange tube, and the first and second legs have free ends disposed at an end opposite the bend portion, the flow passage configured to pass a second portion of the first fluid inside the second heat exchange tube to establish a heat exchange relationship with the second fluid passing over outside the second heat exchange tube, the bend portion includes a first bend that connects the first leg to the bend portion and a second bend that connects the bend portion to the second leg, the first and second bends create a fluid flow opening proximate the bend portion configured to promote fluid flow through the fluid flow opening of the second heat exchange tube and to pass outside the second heat exchange tube, the first heat exchange tube and the second heat exchange tube being alternatingly arranged such that the first heat exchange tube and the second heat exchange tube are flipped 180° relative to each other such that the second bend of one of the first heat exchange tube and the second heat exchange tube is disposed in a length direction of the second leg of the one of the first heat exchange tube and the second heat exchange tube, the length direction defined from the free ends of the one of the first heat exchange tube and the second heat tube and the second heat exchange tube, so that the second bend of the one of the first heat exchange tube and the second heat exchange tube extends beyond the bend portion of the other of the first heat exchange tube and the second heat exchange tube in the length direction, the fluid flow gap being defined by the second bend of the one of the first heat exchange tube and the second heat exchange tube, which extends in the length direction beyond the bend portion of the other of the first heat exchange tube or the second heat exchange tube;

directing the second fluid through the fluid flow gap at the ends of the heat exchange tubes where the bend portions are disposed; and limiting increase in pressure drop when the second fluid passes through the fluid flow gap.

12. The method of claim 11, wherein the directing the second fluid flow over and outside of the arrangement of heat exchange tubes includes directing the second fluid to flow horizontally.

13. The method of claim 11, wherein the directing the second fluid through the fluid flow gap includes directing the second fluid to flow horizontally.

14. The method of claim 11, wherein the wherein the second leg of the first heat exchange tube is oriented relatively above the first leg, the second leg having dimples to promote turbulence of the first fluid flowing inside the flow passage, the dimples forming an internal gap in the flow passage, the internal gap being at or about 13% or greater than an outer diameter of the heat exchange tube.

15. The method of claim 11, wherein the second leg of the second heat exchange tube is oriented relatively above the first leg, the second leg having dimples to promote turbulence of the first fluid flowing inside the flow passage, the dimples forming an internal gap in the flow passage, the internal gap being at or about 13% or greater than an outer diameter of the heat exchange tube.

* * * * *